US006163944A

United States Patent [19]

Lin

[11] Patent Number: 6,163,944

[45] Date of Patent: Dec. 26, 2000

[54] YARN BLOWING DEVICE

[76] Inventor: Sue-Ping Lin, 8F-2, No. 188, Ta Tung Rd., San Hsia Town, Taipei Hsien, Taiwan

[21] Appl. No.: 09/531,435

[22] Filed: Mar. 20, 2000

[51] Int. Cl.[7] ..... D02G 1/16; D02J 1/08

[52] U.S. Cl. ..... 28/274; 28/271

[58] Field of Search ..... 28/271, 272, 274, 28/275, 276, 273, 254; 57/289, 333, 350, 908

[56] References Cited

U.S. PATENT DOCUMENTS

| | | | |
|---|---|---|---|
| 4,547,938 | 10/1985 | Cullen et al. | 28/272 |
| 4,936,000 | 6/1990 | Nabulon et al. | 28/272 |
| 4,953,271 | 9/1990 | Wellenhofer et al. | 28/272 |
| 5,475,908 | 12/1995 | Scherpf et al. | 28/272 |
| 5,475,909 | 12/1995 | Heil et al. | 28/272 |
| 5,839,176 | 11/1998 | Lin | 28/272 |
| 5,964,015 | 10/1999 | Sear | 28/274 |

*Primary Examiner*—Amy B Vanatta
*Attorney, Agent, or Firm*—Bacon & Thomas, PLLC

[57] ABSTRACT

A yarn blowing device used in conjunction with a nozzle is disclosed. The device comprises a base having air inlet in one portion, a housing provided on the other portion of base having a driving shaft with upper portion protruded above housing and lower portion received in bore, a cam mounted to bottom end of shaft, an engagement means provided in one side of housing, and a sliding block provided between base and housing having an opening in one portion for receiving cam and the other portion formed as member with an air hole. In use, rotate shaft and cam to reciprocatively move the engaged opening of sliding block along a predetermined direction such that air inlet of base may periodically be in and out of communication with air hole of sliding block for introducing high pressure air from nozzle to blow yarn passing through the member. Also, lift shaft to disengage cam from opening for pulling sliding block out of the device for cleaning.

7 Claims, 5 Drawing Sheets

YARN BLOWING DEVICE

FIELD OF THE INVENTION

The present invention relates to knitting machine and more particularly to a yarn blowing device mounted in the vicinity of a high pressure nozzle.

BACKGROUND OF THE INVENTION

A conventional yarn blowing device used in conjunction with nozzle is disadvantageous because 1) it has many complex components, 2) it is difficult to manufacture, 3) it is relatively high in cost, 4) it is time consuming in assembly, and 5) it is not convenient in use.

Additionally, nozzle is susceptible to blockage after a predetermined period of time of using in blowing yarn. This bothers operator very much. Further, some of such prior art nozzles are integrally formed, and thus making disassembly impossible, while some are difficult to disassemble which in turn may inadvertently damage nozzles.

Thus, it is desirable to provide a new and improved yarn blowing device in order to overcome the above drawbacks of prior art.

SUMMARY OF THE INVENTION

It is an object of the present invention to provide a yarn blowing device. In use, cam mounted to an end of driving shaft is rotatable to reciprocatively move the engaged opening of sliding block along a predetermined direction such that air inlet of base may periodically be in and out of communication with air hole of member for introducing high pressure air from nozzle to blow yarn passing through V-shaped groove. In disassembly the sliding block, lift driving shaft to disengage cam from opening for pulling sliding block out of the device. Thus, the cleaning of sliding block is easier to carry out.

It is another object of the present invention to provide a yarn blowing device wherein two fastening members are spaced apart on member of sliding block for securing thereon. Also, use a different member in any of other implementations to replace the predetermined member is possible.

The above and other objects, features and advantages of the present invention will become apparent from the following detailed description taken with the accompanying drawings.

DETAILED DESCRIPTION OF THE PREFERRED EMBODIMENTS

Referring to FIGS. 1–5, there is shown a yarn blowing device constructed in accordance with the invention comprising a base 10, a housing 20, an engagement means 30, and a sliding block 40. The description of above components is detailed below.

Figure 2:
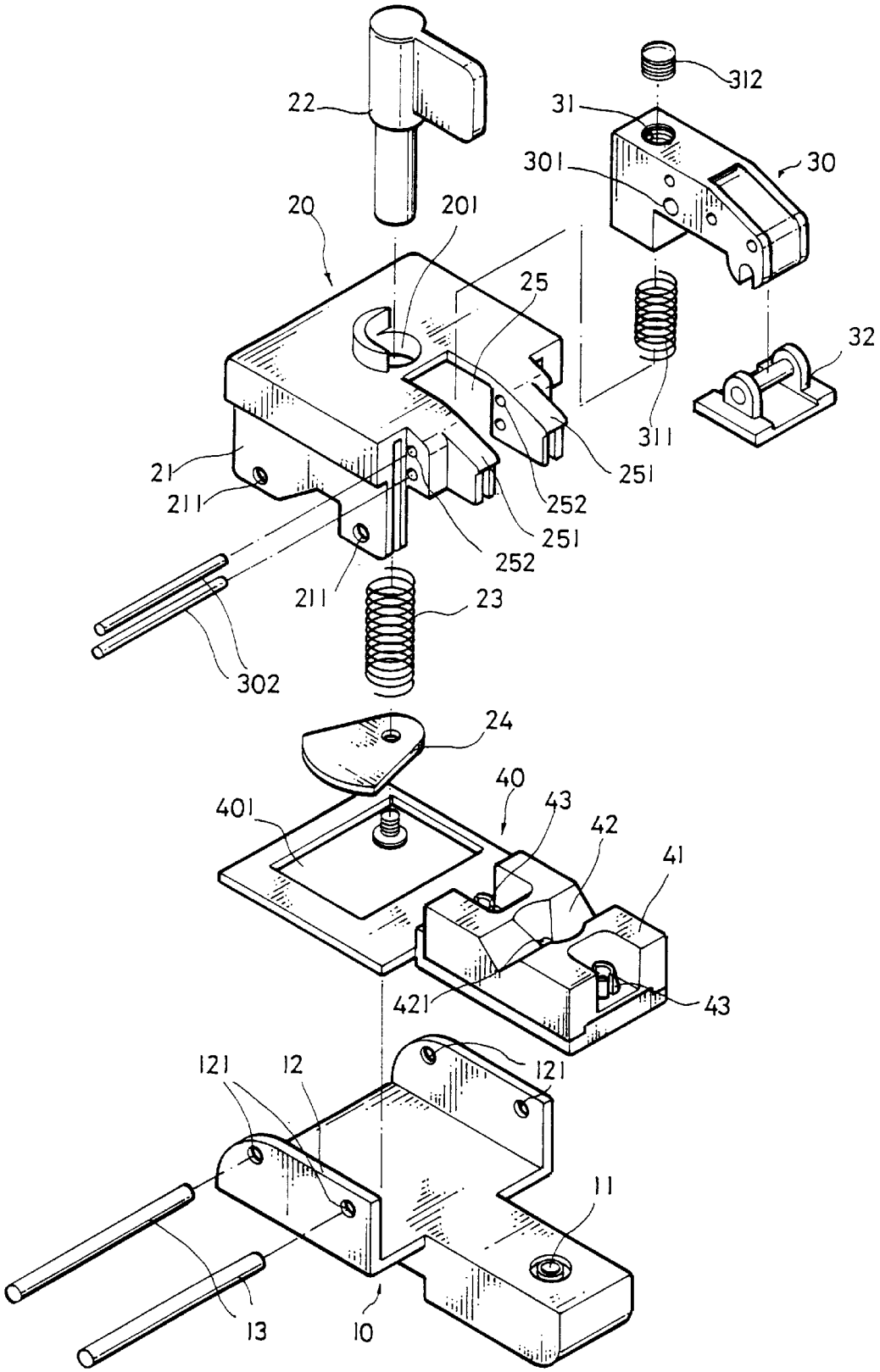
FIG. 2 is an exploded view of the yarn blowing device of FIG. 1.

Base 10 comprises an air inlet 11 in one portion and two opposing upwardly sides 12 in the other portion wherein each side 12 has a plurality of holes 121 (FIG. 2).

Figure 1:
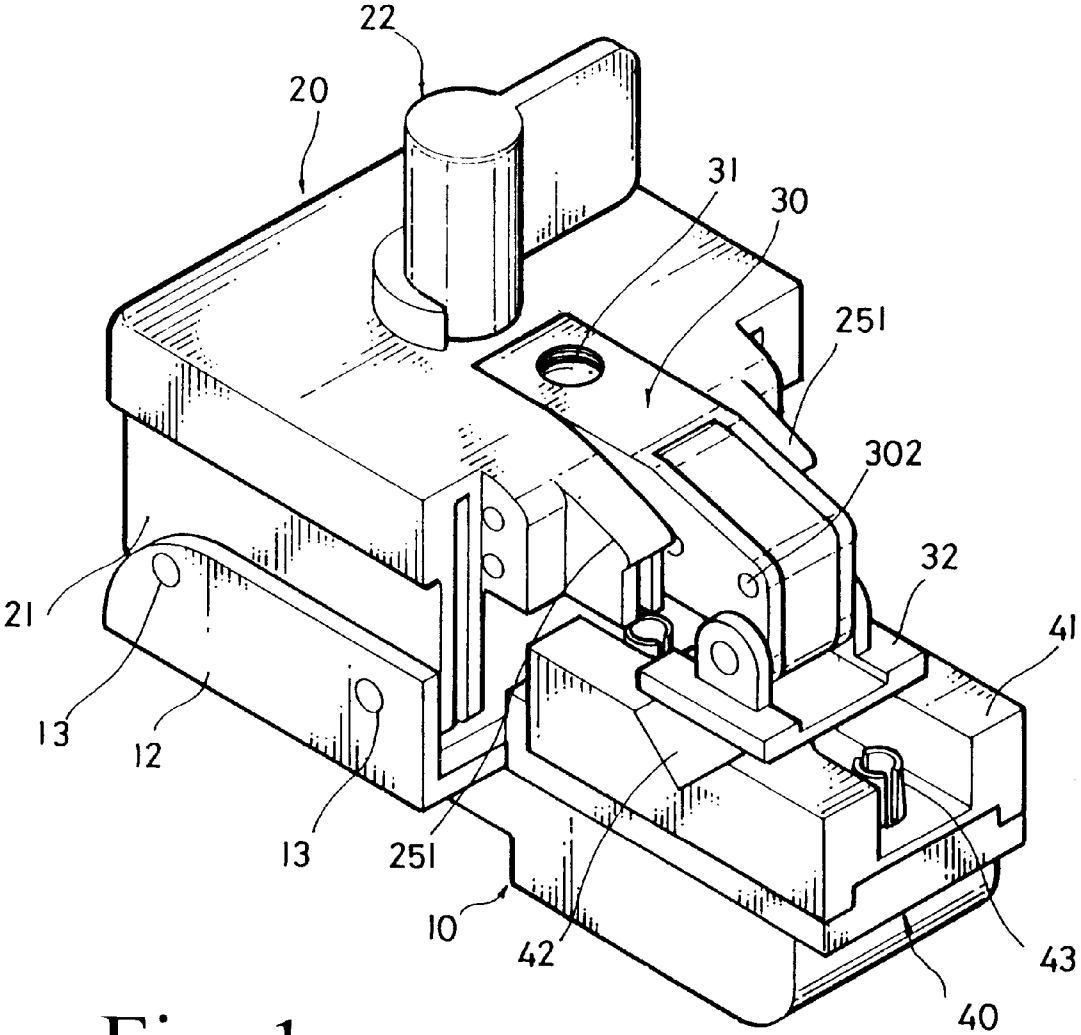
FIG. 1 is a perspective view of a preferred embodiment of yarn blowing device of the invention.

Housing 20 fits snugly between two sides 12 of base 10. Housing 20 comprises two opposing sides 21 each having a plurality of holes 211. A plurality of fasteners 13 are inserted through holes 121 of base 10 and holes 211 of housing 20 so as to secure housing 20 to base 10 (FIG. 1).

Figure 3:
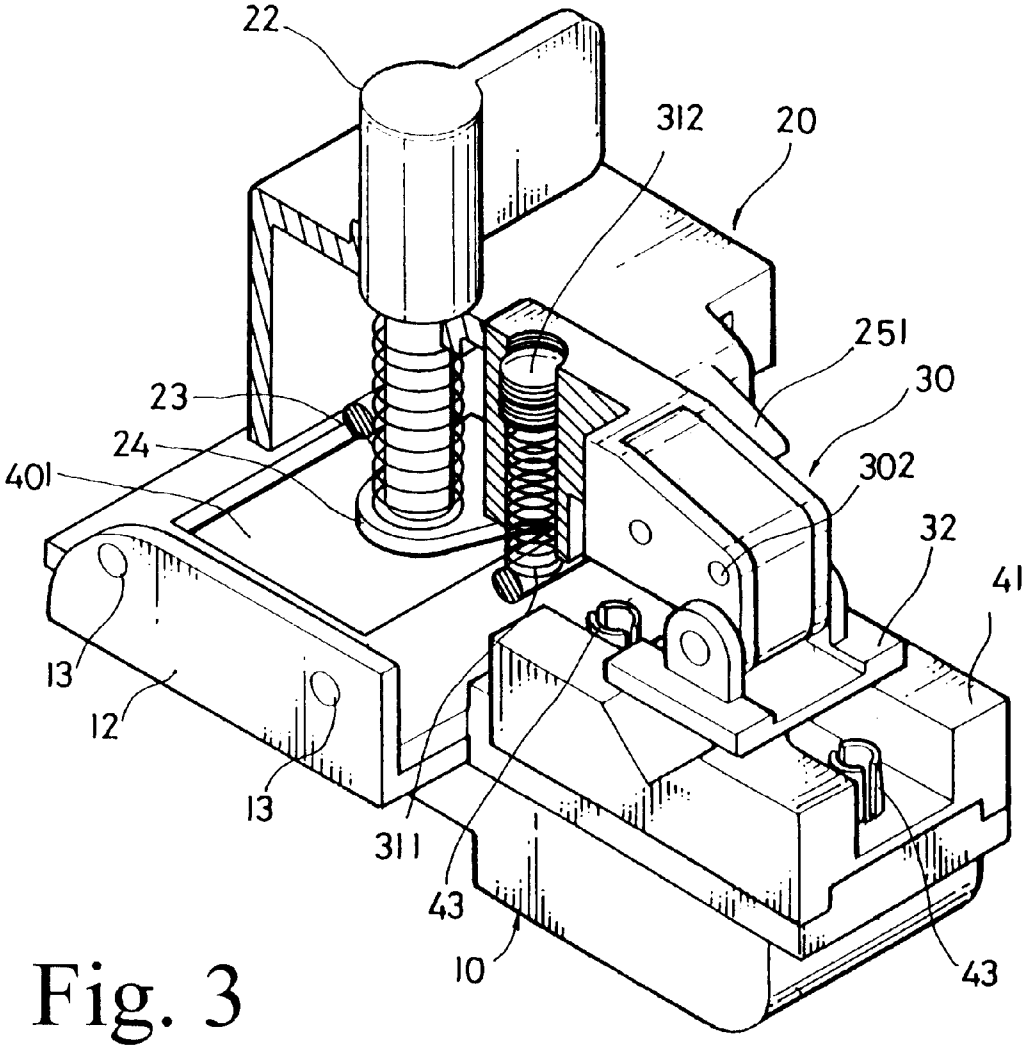
FIG. 3 is a perspective view of yarn blowing device with certain portions removed to reveal some features of the invention.

Housing 20 further comprises a bore 201 on top and a recess 25 in the side corresponding to air inlet 11 of base 10. Driving shaft 22 is integrally formed with two portions, i.e., an upper portion and a lower portion having a diameter smaller than that of upper portion. As such, lower portion of driving shaft 22 may insert through bore 201 until upper portion of driving shaft 22 is blocked by bore 201. An elastic member (e.g., coil spring as shown in FIGS. 2 and 3) 23 is put on lower portion of driving shaft 22. A cam 24 is mounted to an end of driving shaft 22. Two opposing projections 251 are protruded beyond two sides of recess 25 with a plurality of holes 252 provided on each projection 251 (FIG. 2).

Engagement means 30 fits snugly between projections 251 of housing 20 having a plurality of holes 301 through the sides. A plurality of second fasteners 30 are inserted through holes 252 of housing 20 and holes 301 of engagement means 30 so as to secure engagement means 30 to housing 20 (FIG. 1).

A vertical aperture 31 is provided near one side of engagement means 30 adjacent recess 25 of housing 20. A second elastic member (e.g., coil spring as shown in FIG. 2) 311 is received in vertical aperture 31 being anchored at one end by a cylindrical member 312. With the provision of second elastic member 311, a resilient adjustment of engagement means 30 is effected. Also, the bottom of the other side of engagement means 30 is secured to an engagement base 32.

Sliding block 40 fits snugly between base 10 and housing 20 having two portions integrally formed together wherein an opening 401 is provided on one portion for receiving cam 24 therein and the other portion is formed as member 41. Top of member 41 is engaged with bottom of engagement base 32 of engagement means 30. A V-shaped groove 42 is provided on member 41. An air hole 421 is provided on bottom of V-shaped groove 42. As such, air inlet 11 of base 10 may be in fluid communication with air hole 421 of member 41 when they are engaged so as to introduce high pressure air from nozzle (not shown) to blow yarn (detailed later).

As shown, two fastening members 43 are spaced apart on member 41 of sliding block 40 for securing thereon. Also, use a different member 41 in any of other implementations to replace the shown member 41 is possible.

Figure 4:
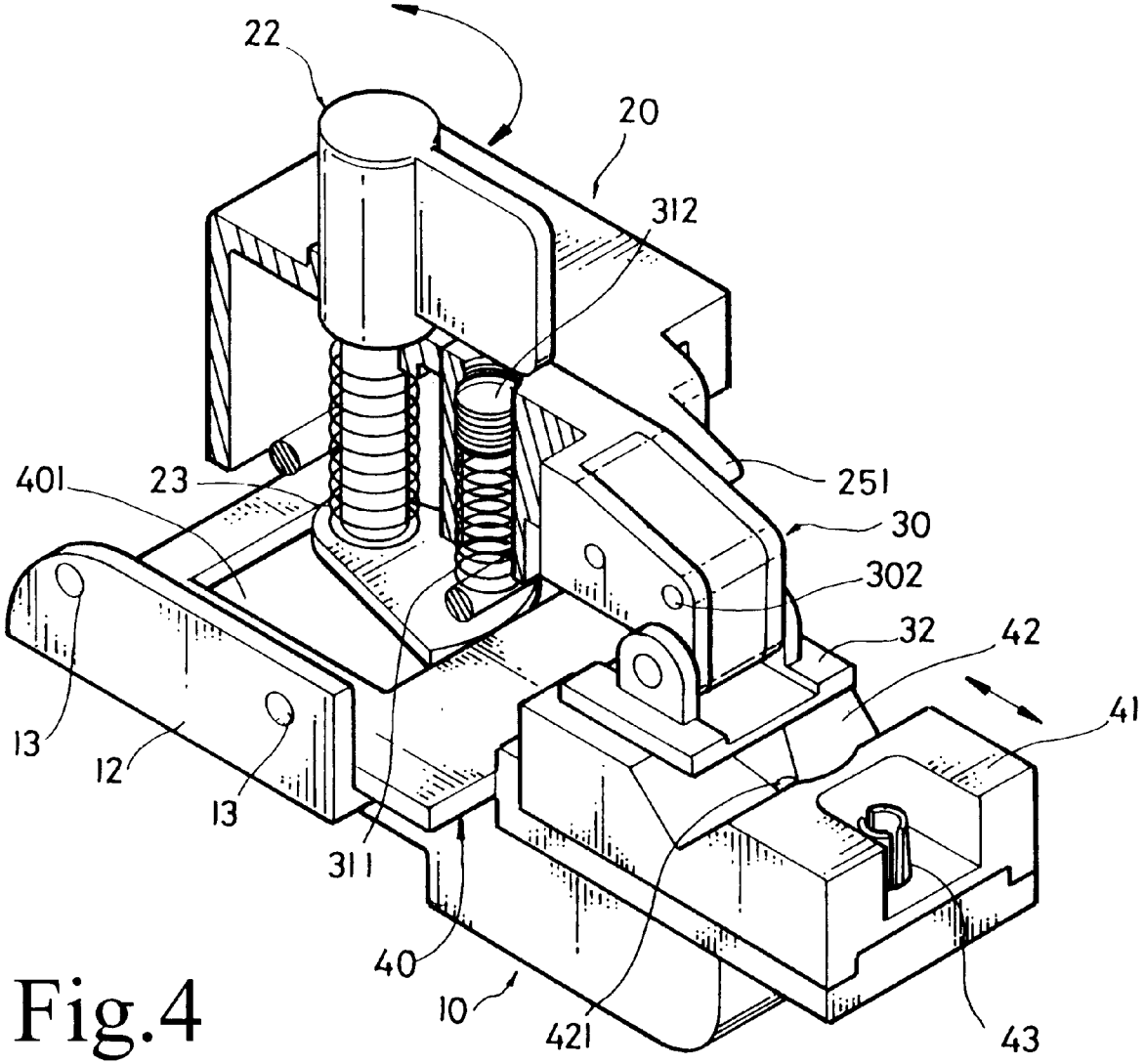
FIG. 4 is similar to FIG. 3 illustrating the reciprocative movement of sliding block along a predetermined direction when driving shaft is rotated.
Figure 5:
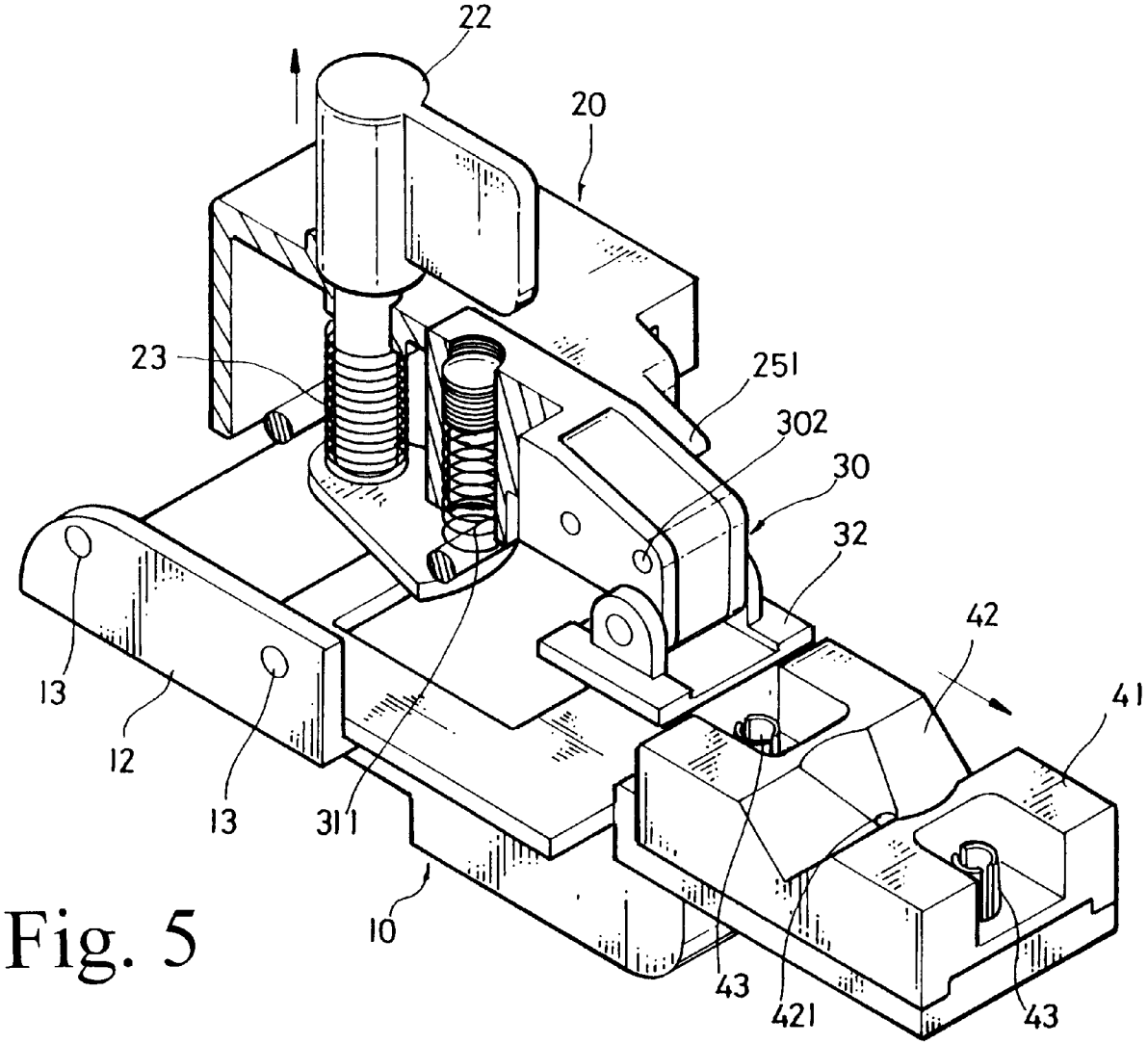
FIG. 5 is similar to FIG. 3 illustrating the disassembly of sliding block of the invention.

In use, first rotate driving shaft 22 in high speed to cause cam 24 at one end thereof to rotate accordingly. The projection portion of cam 24 then reciprocatively moves the engaged opening 401 of sliding block 40 along a predetermined direction such that air inlet 11 of base 10 may periodically be in and out of communication with air hole 421 of member 41 for introducing high pressure air from nozzle to blow yarn (not shown) passing through V-shaped groove 42 (FIG. 4). Also, yam will not be blown up significantly due to the engagement of engagement base 32 of engagement means 30 with member 41. In disassembly the sliding block 40, lift driving shaft 22 to disengage cam 24 from opening 401 of sliding block 40 for pulling sliding block 40 out of the device (FIG. 5). Thus, the cleaning of sliding block 40 is easier to carry out.

While the invention herein disclosed has been described by means of specific embodiments, numerous modifications and variations could be made thereto by those skilled in the art without departing from the scope and spirit of the invention set forth in the claims.

What is claimed is:

1. A yarn blowing device used in conjunction with a nozzle comprising:

a base consisting of two portions with an air inlet in one portion;

a housing provided on the other portion of the base having a bore on top and a recess in the side corresponding to the air inlet of the base;

a driving shaft having an upper portion protruded above the housing and a lower portion received in the bore of the housing;

an elastic means put on the lower portion of the driving shaft;

a cam mounted to the bottom end of the driving shaft;

an engagement means having one side received in the recess of the housing;

an engagement base secured to the bottom of the other side of the engagement means;

a sliding block provided between the base and the housing having an opening in one portion for receiving the cam therein; and a member formed on the other portion of the sliding block being in contact with the engagement base having a V-shaped groove with an air hole, wherein in use, rotate the driving shaft to cause the cam to reciprocatively move the engaged opening of the sliding block along a predetermined direction such that the air inlet of the base may periodically be in and out of communication with the air hole of the sliding block for introducing high pressure air from the nozzle to blow yarn passing through the member; and while lift the driving shaft to disengage the cam from the opening of the sliding block for pulling the sliding block out of the device.

2. The yarn blowing device of claim 1, wherein the base further comprises two opposing upwardly sides in the other portion for receiving the housing and each of the sides has a plurality of holes.

3. The yarn blowing device of claim 2, wherein the housing further comprises two opposing sides each having a plurality of holes such that a plurality of first fasteners may insert through the holes of the base and the holes of the housing.

4. The yarn blowing device of claim 1, wherein the recess of the housing comprises two opposing projections protruded beyond the sides of the recess and a plurality of holes provided on each of the projections.

5. The yarn blowing device of claim 4, wherein the engagement means further comprises a plurality of holes through the sides such that a plurality of second fasteners may insert through the holes of the housing and the holes of the engagement means.

6. The yarn blowing device of claim 1, wherein the engagement means further comprises a vertical aperture provided adjacent the recess of the housing, a second elastic means received in the vertical aperture, and a fastening member anchored at one end of the second elastic means such that a resilient adjustment of the engagement means is effected.

7. The yarn blowing device of claim 1, wherein the member of the sliding block further comprises two spaced fastening members secured thereon which are selected from a plurality of fastening members.

* * * * *